US006092308A

United States Patent [19]

Srourian

[11] Patent Number: 6,092,308

[45] Date of Patent: Jul. 25, 2000

[54] UNITARY SHOE BOTTOM

[75] Inventor: Nichan Srourian, Studio City, Calif.

[73] Assignee: Reflections Shoe Corp., Sun Valley, Calif.

[21] Appl. No.: 09/197,613

[22] Filed: Nov. 23, 1998

[51] Int. Cl.[7] ..... A43B 13/14

[52] U.S. Cl. ..... 36/24.5; 36/25 R; 36/11.5

[58] Field of Search ..... 36/107, 108, 24.5, 36/11.5, 137, 25 R

[56] References Cited

U.S. PATENT DOCUMENTS

| | | |
|---|---|---|
| 2,468,573 | 4/1949 | Rimer . |
| 2,599,740 | 6/1952 | Beveridge . |
| 2,744,340 | 5/1956 | Gerber . |
| 3,742,625 | 7/1973 | Famolare, Jr. . |
| 3,890,725 | 6/1975 | Lea et al. . |
| 4,020,572 | 5/1977 | Chiaramonte, Jr. . |
| 4,348,820 | 9/1982 | D'Alessio . |
| 4,497,123 | 2/1985 | Ehrlich . |
| 5,454,382 | 10/1995 | Tariah et al. . |

*Primary Examiner*—Ted Kavanaugh
*Attorney, Agent, or Firm*—Thomas I. Rozsa; Tony D. Chen; Jerry Fong

[57] ABSTRACT

A unitary hollow shoe bottom comprises a bottom and a sidewall integrally molded with the bottom and extends upwardly to form a cavity and a periphery top edge surrounding the cavity. The unitary hollow shoe bottom further comprises a thick platform section and a raised rear high heel section, where the raised rear heel section is elevated substantially above the thick platform section. A reinforcing brace member is transversely positioned across the platform section and secured within two opposite offset recesses located on the periphery top edge and flush with the periphery top edge for supporting the ball of the foot of a person.

22 Claims, 3 Drawing Sheets

UNITARY SHOE BOTTOM

BACKGROUND OF THE INVENTION

1. Field of the Invention

The present invention generally relates to the field of design and construction of shoes. More particularly, the present invention relates to shoe bottoms for women general footwear.

2. Description of the Prior Art

A shoe is generally comprised of an upper, an insole or midsole, and a sole. The upper comes in contact with the foot of a user and may be made of leather straps, synthetic material or cloth, and is commonly called a sandal. The upper also may be made to cover the whole foot and is commonly called a pump, moccasin or boot. The insole is the part of the shoe upon which the foot rests. The sole is part of the shoe which comes in contact with the ground. The function of the sole is to withstand abrasion, be flexible, and comfortable.

Typically, in the construction of a shoe, the sole can be attached to the insole by adhesive means, while the heel has to be nailed to a very structurally strong insole. In addition, the insole also provides another function for holding firmly together the platform and the heel portions of the sole. Therefore, it is specially made to provide a body to the shoe having the function of serving as the backbone in the structure.

High heel shoes are generally constructed of high heel soles. A high heel sole typically consists of a forward toe portion and a raised heel portion. An insole overlies the upper side of the sole and is suitably sealed and secured thereto in a conventional manner. The high heel is then attached to the raised heel portion of the sole by conventional means.

One of the problems in constructing the prior art high heel shoes is that they often have very complicated structures. This often increases the manufacturing costs. Another problem with prior art high heel shoes is that they are not durable. Oftentimes the high heel is made of plastic which can easily break and also has problems such as nails coming off. In most prior art design and construction of the shoe, the high heel is directly attached to the raised heel portion of the sole of the shoe. Therefore, the strength and durability of the attachment is limited by the properties of the materials being used for the construction of the heel and the sole of the shoe.

The following ten (10) prior art patents are found to be pertinent to the field of the present invention:

1. U.S. Pat. No. 2,165,427 issued to Vigorith et al. on Jul. 11, 1939 for "Shoe Sole And Heel Construction" (hereafter the "Vigorith Patent");
2. U.S. Pat. No. 2,303,431 issued to Brophy on Dec. 1, 1942 for "Shoe And Shoe Bottom Unit" (hereafter the "Brophy Patent");
3. U.S. Pat. No. 2,912,772 issued to Harrison on Nov. 17, 1959 for "Shoe Structure Having Molded Basic Units" (hereafter the "Harrison Patent");
4. U.S. Pat. No. 4,073,074 issued to Rabin et al. on Feb. 14, 1978 for "Ladies Shoe Construction" (hereafter the "Rabin Patent");
5. U.S. Pat. No. 4,198,769 issued to Rigon on Apr. 22, 1980 for "Boots Of Injection Molded Plastic" (hereafter the "Rigon Patent");
6. U.S. Pat. No. 4,244,070 issued to Ughi on Jan. 13, 1981 for "Sole With Heel For Women Footwears Or Shoes, And Method For Quickly And Economically Making Said Soles With Corresponding Heels" (hereafter the "Ughi Patent");
7. Belgium Patent No. 555,776 (hereafter the "Belgium Patent");
8. French Patent No. 917,9160 (hereafter the "'910 French Patent");
9. French Patent No. 1,168,711 (hereafter the "'711 French Patent"); and
10. French Patent No. 1,400,932 (hereafter the "'932 French Patent").

The Vigorith Patent discloses a shoe sole and heel construction. It comprises a sole with a rear portion for attachment to a heel. The rear portion has an anchoring portion with a recess for receiving a tongue which is attached to the heel. The tongue is permanently affixed to the recess for securing the heel to the sole. The Vigorith Patent does not teach an interchangeable heel.

The Brophy Patent discloses a shoe and shoe bottom unit. It comprises a high heel portion, and a shank portion which is integral with the heel portion and extends forwardly and downwardly from the upper part of the heel portion to form a flat sole-attaching face. A sole is attached to the face of the shank portion by cement. The Brophy Patent does not teach an interchangeable heel.

The Harrison Patent discloses a shoe structure having molded basic units. It comprises a basic sole unit and a unitary heel and shank unit. The basic sole unit has a bottom heel area, a forepart sole area, and an intervening shank area merged with the bottom heel area and with the forepart sole area. The unitary heel and shank unit is respectively affixed to the bottom heel area and the intervening shank area. The Harrison Patent does not teach an interchangeable heel.

The Rabin Patent discloses ladies shoe construction. It comprises a heel, an outsole, an insole, a filler, a liner, and an upper. The Rabin Patent does not teach an interchangeable heel.

The Rigon Patent discloses boots of injection molded plastic. It comprises a reinforced arch and heel construction to which a reinforced insole member is formed in a single piece with a rigid heel portion.

The Ughi Patent discloses a sole with heel for women's footwear or shoes, and method for quickly and economically making said soles with corresponding heels. The Ughi Patent does not teach an interchangeable heel.

The Belgium Patent, as disclosed from the figures shows a heel portion, a shank portion, and a forepart portion, wherein the shank portion is affixed to the top of the heel portion and the forepart portion is affixed to the lower end of the shank portion.

The '910 French Patent, as disclosed from the figures shows a shank portion affixed to a heel assembly.

The '711 French Patent, as disclosed from the figures shows a three-piece shoe unit.

The '932 Patent, as disclosed form the figures shows a two-piece shoe unit.

It is desirable to design and construct a unitary shoe bottom which is easy to handle, durable and inexpensive to manufacture. It is also desirable to have a very efficient and also very effective design and construction of a unitary shoe bottom to overcome the problems of the prior art.

SUMMARY OF THE INVENTION

The present invention is a unitary hollow shoe bottom which comprises a bottom and a sidewall integrally molded with the bottom and extends upwardly to form a cavity and a periphery top edge surrounding the cavity. The unitary hollow shoe bottom further comprises a thick platform section and a raised rear high heel section, where the raised rear heel section is elevated substantially above the thick platform section. A brace member is transversely positioned cross the platform section and secured within two opposite offset recesses located on the periphery top edge and flush with the periphery top edge for supporting the ball of the foot of a person.

It is an object of the present invention to provide a unitary hollow shoe bottom which is inexpensive to manufacture, lightweight and easy to assemble.

It is also an object of the present invention to provide a brace member which is transversely positioned cross the platform section of the unitary hollow shoe bottom and secured thereto for supporting the ball of the foot of a person.

It is a further object of the present invention to provide a unitary hollow shoe bottom which comprises a brace member integrally molded between the interior walls at the platform section for supporting the ball of the foot of a person.

In a preferred embodiment of the present invention, the unitary hollow shoe bottom comprises a thick front platform section and a raised rear high heel section integrally formed with the platform section, and a supporting brace member transversely positioned cross the platform section and secured thereto on the periphery edge of the hollow shoe bottom for supporting the ball of the foot of a person.

In an alternative embodiment of the present invention, the unitary hollow shoe bottom comprises a thick platform section, a raised high heel section integrally formed with the platform section, and a supporting brace member transversely and integrally formed with the interior of the hollow shoe bottom for supporting the ball of the foot of a user.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
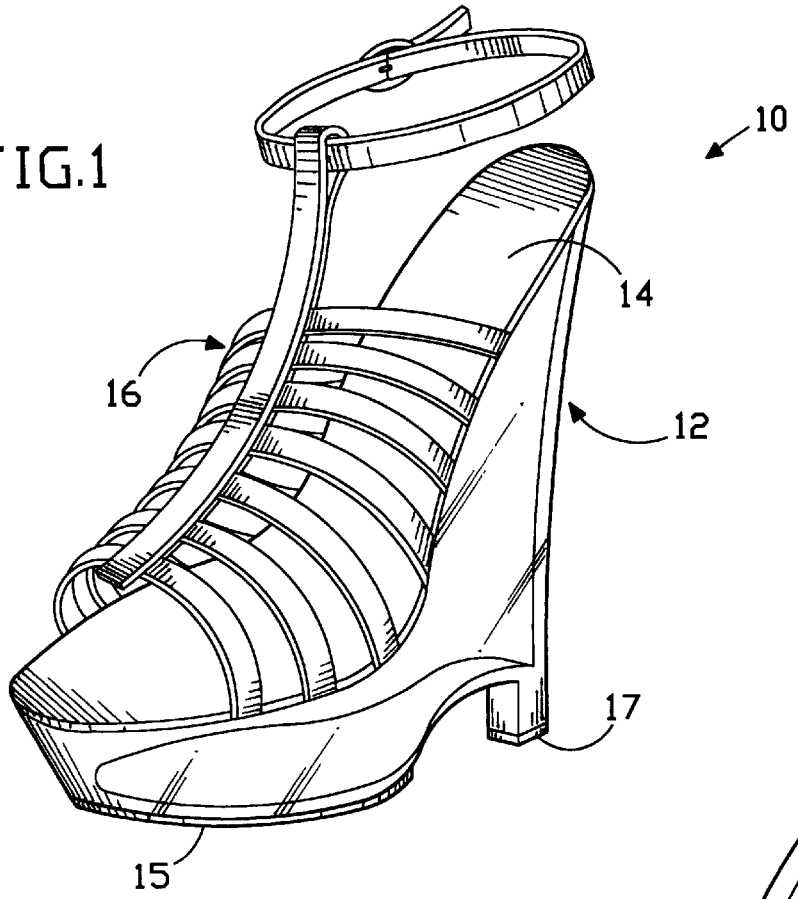
FIG. 1 is a perspective view of an assembled woman's shoe utilizing the present invention unitary hollow shoe bottom.

Referring to FIG. 1, there is depicted at 10 an assembled right woman's shoe utilizing the present invention unitary hollow shoe bottom 12. The assembled shoe 10 may further comprise an insole 14 which overlies on the entire top of the hollow shoe bottom 12, and leather straps or upper 16 affixed between the insole 14 and the unitary hollow shoe bottom 12 for securing a user's foot (not shown) to the shoe 10.

Figure 2:
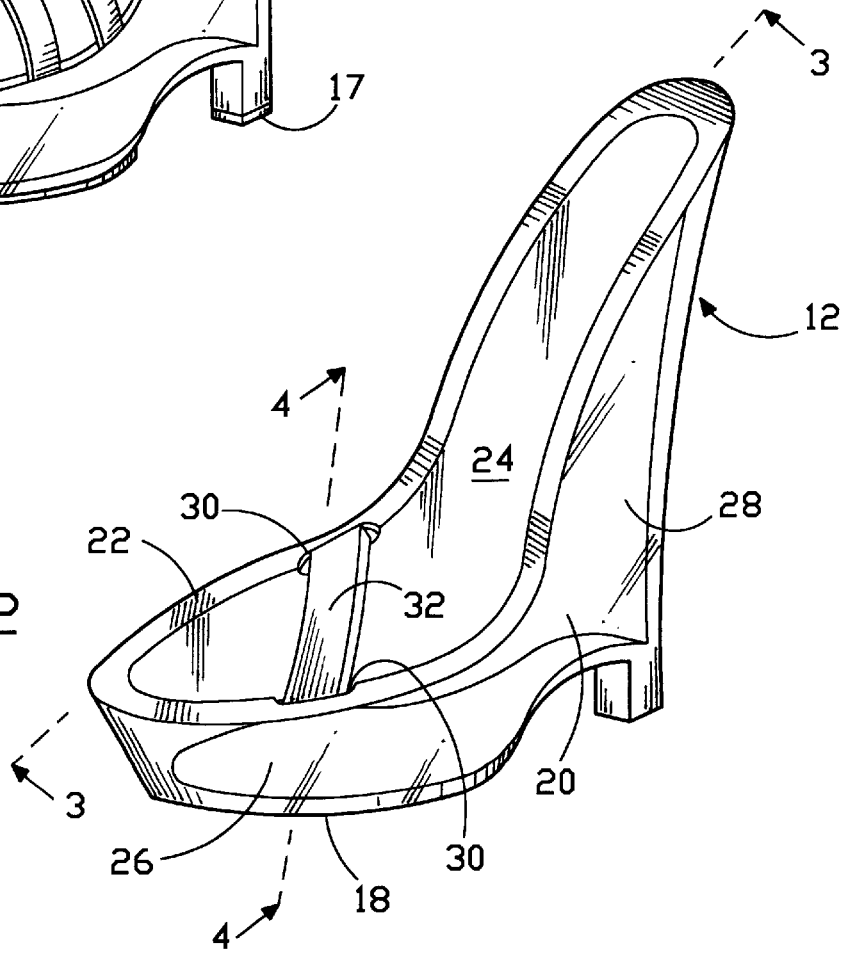
FIG. 2 is a perspective view of a preferred embodiment of the present invention unitary hollow shoe bottom.
Figure 4:
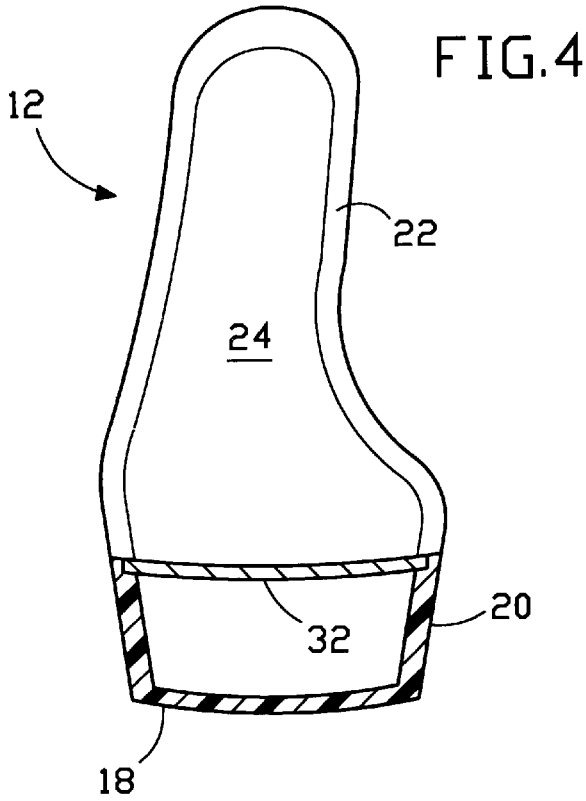
FIG. 4 is a cross-sectional view taken along 4—4 of FIG. 2.
Figure 3:
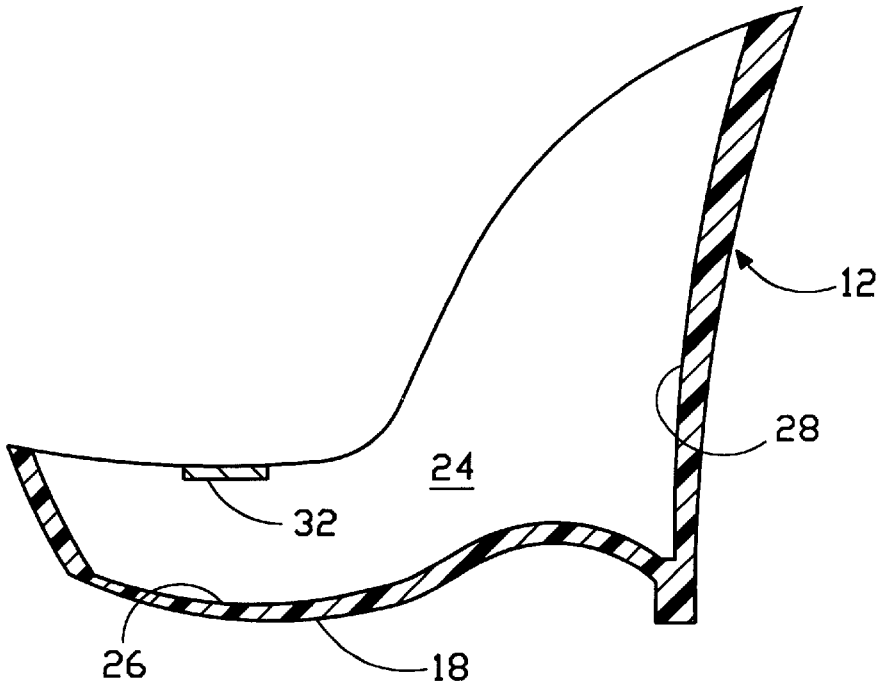
FIG. 3 is a cross-sectional view taken along 3—3 of FIG. 2.

Referring to FIGS. 2, 3 and 4, the hollow shoe bottom 12 comprises a bottom 18, a sidewall 20 which is integrally molded with the bottom 18 and extends upwardly to form a cavity 24 and an upper periphery edge 22 which surrounds the cavity 24. One of the unique features of the hollow shoe bottom is the cavity 24 which reduces the weight of the shoe bottom 12. The hollow shoe bottom 12 further has a thick front platform section 26 and a raised rear heel section 28. The upper edge 22 has two opposite offset recesses 30 located at the platform section 26 of the hollow shoe bottom 12.

A rigid brace member 32 is provided with the present invention unitary hollow shoe bottom 12 and is generally a rectangular shape. The rigid brace member 32 is sized to be transversely positioned across the platform section 28 and secured within the two opposite offset recesses 30 by glue means or any other suitable means. The rigid brace member 32 is flush with the upper periphery edge 22 so that a smooth surface is provided when the insole 14 is affixed to the upper periphery edge 22 of the hollow shoe bottom 12. Another feature of the present invention shoe bottom 12 is that the brace member 32 is located on the platform section 26 for supporting the ball of the foot of a person, and thereby the unitary hollow shoe bottom 12 does not require any other support therein. The brace member 32 is generally made out of metal material. Another benefit of locating the brace member at this location is that it is invisible and will not be seen even though the shoe bottom 12 may be made of clear material.

Referring again to FIG. 1, a pad 15 may be also provided with the present invention unitary shoe bottom 12 and attached to the bottom of the platform section 26 for contacting the ground and protecting the bottom of the hollow shoe bottom 12. A top-lift 17 may be also provided with the shoe bottom 12 and attached to the bottom of the raised rear heel section 28.

The present invention conforms to conventional forms of manufacture, and is of simple construction and is easy to use. The hollow shoe bottom 12 can be made from several materials. The manufacturing process which could accommodate the construction of the hollow shoe bottom 12 may be injection molding, thermoforming, etc. or other molding process. By way of example, the shoe bottom 12 can be made of plastic material, for example, polycarbonate resin, ABS resin or any other suitable material.

The present invention has many advantageous features including: (a) it is inexpensive to manufacture and cost effective; (b) the cavity reduces the weight of the unitary shoe bottom; and (c) it is easy to assemble an entire woman's shoe.

Figure 5:
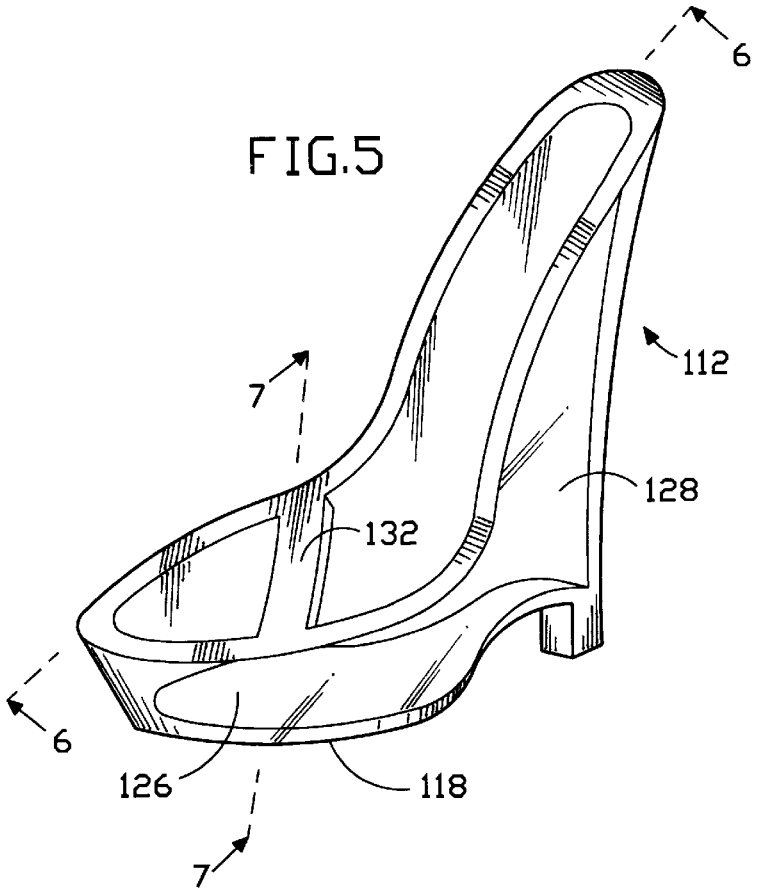
FIG. 5 is a perspective view of an alternative embodiment of the present invention unitary hollow shoe bottom.
Figure 7:
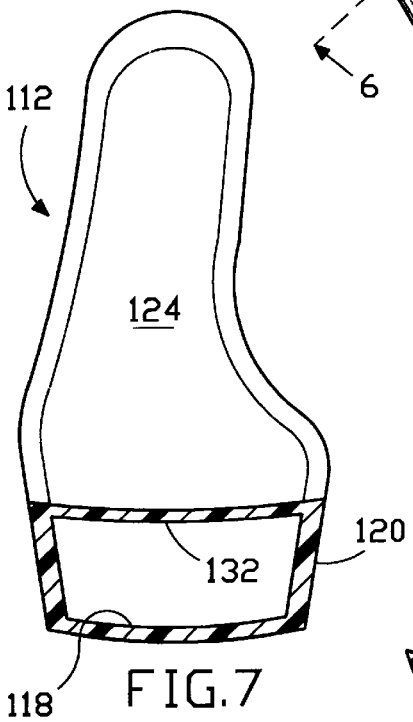
FIG. 7 is a cross-sectional view taken along 7—7 of FIG. 5.
Figure 6:
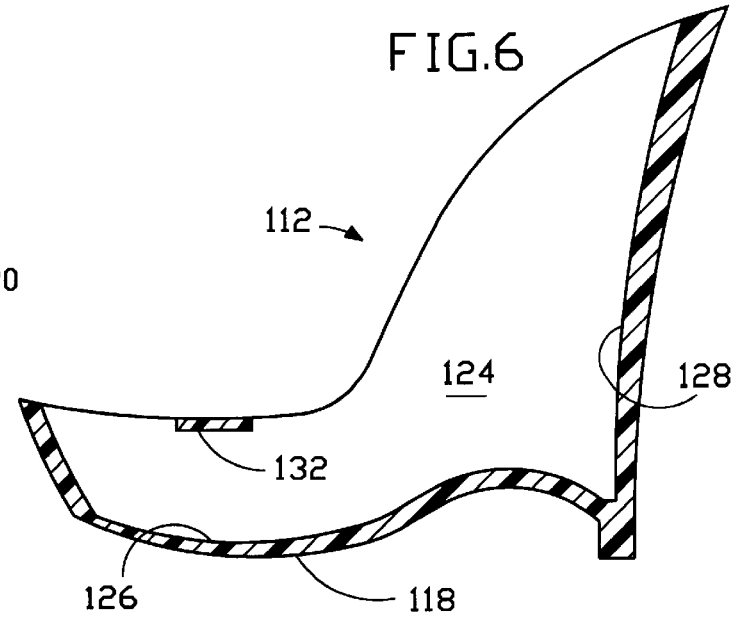
FIG. 6 is a cross-sectional view taken along 6—6 of FIG. 5.

Referring to FIGS. 5, 6 and 7, there is shown an alternative embodiment of the present invention unitary hollow shoe bottom 112 which is very similar to the preferred embodiment just discussed and the only difference is the nature and configuration of the rigid brace member 132. All of the parts of the alternative embodiment of the present invention unitary hollow shoe bottom 112 are numbered correspondingly with 100 added to each number.

The hollow shoe bottom 112 comprises a bottom 118, a sidewall 120 which is integrally molded with the bottom 118 and extends upwardly to form a cavity 124 and an upper periphery edge 122 which surrounds the cavity 124. One of the unique features of the hollow shoe bottom 112 is the cavity 124 which reduces the weight of the hollow shoe bottom 112. The hollow shoe bottom 112 farther has a thick front platform section 126 and a raised rear heel section 128.

A brace member 132 is integrally formed with the interior sidewall 120 of the shoe bottom 112 and located on the platform section 126 such that the brace member 132 is flush with the upper periphery edge 122 so that a smooth surface is provided when the insole 14 (see FIG. 1) is affixed to the upper periphery edge 122 of the hollow shoe bottom 112. The brace member 132 is generally a rectangular shape. Another unique feature of the present invention shoe bottom 112 is that the brace member 132 is located on the platform section 126 for supporting the ball of the foot of a person, and thereby the unitary hollow shoe bottom 112 does not require any other support therein.

Defined in detail, the present invention is a shoe bottom, comprising: (a) a unitary hollow shoe sole structure having a bottom and a sidewall integrally formed with the bottom and extending upwardly to form a cavity with a thick platform section and a raised rear heel section, the sidewall having a periphery top edge surrounding the platform section and the raised rear heel section, the periphery top edge having two opposite offset recesses located on the platform section; and (b) a rigid brace member sized to be transversely positioned across the platform section and secured within the two opposite offset recesses and flush with the periphery top edge at the platform section for supporting a ball of the foot of a person.

Alternatively defined in detail, the present invention is a shoe bottom, comprising: (a) a unitary hollow shoe sole structure having a bottom and a sidewall integrally formed with the bottom and extending upwardly to form a cavity with a thick platform section and a raised rear heel section, the sidewall having a periphery top edge surrounding the platform section and the raised rear heel section, the periphery top edge having two opposite offset recesses located on the platform section; and (b) a brace member sized to be transversely positioned across the platform section and integrally formed with the interior of the sidewall and flush with the periphery top edge at the platform section for supporting a ball of the foot of a person.

Defined broadly, the present invention is a shoe bottom, comprising: (a) a bottom and a sidewall integrally formed with the bottom and extending upwardly to form a platform section and a heel section; and (b) supporting means transversely positioned across the platform section and secured thereto for supporting a ball of the foot of a person.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A shoe bottom, comprising:

a. a unitary hollow shoe sole structure having a bottom and a sidewall integrally formed with the bottom and extending upwardly to form a cavity with a thick platform section and a raised rear heel section, the sidewall having a periphery top edge surrounding the platform section and the raised rear heel section, the periphery top edge having two opposite offset recesses located on the platform section; and b. a rigid brace member sized to be transversely positioned across said platform section and secured within said two opposite offset recesses and flush with said periphery top edge at said platform section for supporting a ball of the foot of a person.

2. The shoe bottom in accordance with claim 1 wherein said hollow shoe sole structure is made of polycarbonate resin.

3. The shoe bottom in accordance with claim 1 wherein said hollow shoe sole structure is made of acrylonitrile butadiene styrene (ABS) resin.

4. The shoe bottom in accordance with claim 1 wherein said hollow shoe sole structure is transparent.

5. The shoe bottom in accordance with claim 1 wherein said brace member is generally a rectangular shape.

6. The shoe bottom in accordance with claim 1 wherein said brace member is made of metal material.

7. The shoe bottom in accordance with claim 1 further comprising a lift attached to a bottom of said raised rear heel section for withstanding abrasion.

8. The shoe bottom in accordance with claim 1 further comprising a pad attached to a bottom of said platform section for withstanding abrasion.

9. The shoe bottom in accordance with claim 1 further comprising an insole sized to cover said cavity of said hollow shoe sole structure and attached to said periphery top edge.

10. The shoe bottom in accordance with claim 9 further comprising an upper attached between said insole and said periphery top edge for securing the person's foot.

11. A shoe bottom, comprising:

a. a unitary hollow shoe sole structure having a bottom and a sidewall formed with the bottom and extending upwardly to form a cavity with a platform section anti a heel section, the sidewall having a periphery top edge surrounding the platform section and the heel section, the periphery top edge having two offset recesses located on the platform section; and b. a brace member positioned only across said platform section of said unitary hollow shoe sole structure and secured within said two offset recesses of said periphery top edge for supporting a ball of the foot of a person.

12. The shoe bottom in accordance with claim 11 wherein said hollow shoe sole structure is made of polycarbonate resin.

13. The shoe bottom in accordance with claim 11 wherein said hollow shoe sole structure is made of acrylonitrile butadiene styrene (ABS) resin.

14. The shoe bottom in accordance with claim 11 wherein said hollow shoe sole structure is transparent.

15. The shoe bottom in accordance with claim 11 wherein said brace member is generally a rectangular shape.

16. The shoe bottom in accordance with claim 11 further comprising a lift attached to a bottom of said heel section for withstanding abrasion.

17. The shoe bottom in accordance with claim 11 further comprising a pad attached to a bottom of said platform section for withstanding abrasion.

18. The shoe bottom in accordance with claim 11 further comprising an insole sized to cover said cavity of said hollow shoe sole structure and attached to said periphery top edge.

19. The shoe bottom in accordance with claim 18 further comprising an upper attached between said insole and said periphery top edge for securing the person's foot.

20. A shoe bottom, comprising:

a. a unitary hollow shoe sole structure having a bottom and a sidewall formed with the bottom and extending upwardly to form a cavity with a platform section and a heel section, the sidewall having a periphery top edge surrounding the platform section and the heel section, the periphery top edge having two recesses located on the platform section; and b. a brace member positioned only across said platform section of said unitary hollow shoe sole structure and secured within said two recesses of said periphery top edge for supporting a ball of the foot of a person.

21. A shoe bottom, comprising:

a. a unitary hollow shoe sole structure having a bottom and a sidewall formed with the bottom and extending upwardly to form a cavity with a platform section and a heel section, the sidewall having a periphery top edge surrounding the platform section and the heel section; and b. a single brace member horizontally positioned only across said platform section of said unitary hollow shoe sole structure and permanently affixed to said periphery top edge at a location for supporting a ball of the foot of a person.

22. A shoe bottom, comprising:

a. a unitary hollow shoe sole structure having a bottom and a sidewall formed with the bottom and extending upwardly to form a cavity with a platform section and a heel section, the sidewall having a periphery top edge surrounding the platform section and the heel section; and b. a single brace member horizontally positioned only across said platform section of said unitary hollow shoe sole structure and located adjacent to said periphery top edge at a location for supporting a ball of the foot of a person.

* * * * *